US007543409B2

(12) United States Patent
Higashitani et al.

(10) Patent No.: US 7,543,409 B2
(45) Date of Patent: Jun. 9, 2009

(54) DOOR PULL AND SASH WINDOW HAVING THE DOOR PULL

(75) Inventors: Norikazu Higashitani, Tokyo (JP); Yoshinori Ishikuro, Toyama (JP); Yasushi Yamamoto, Kurobe (JP); Hiroaki Kubo, Namerikawa (JP); Shuhei Ohno, Kashiwara (JP)

(73) Assignee: YKK AP Inc., Tokyo (JP)

( * ) Notice: Subject to any disclaimer, the term of this patent is extended or adjusted under 35 U.S.C. 154(b) by 253 days.

(21) Appl. No.: 10/945,012

(22) Filed: Sep. 20, 2004

(65) Prior Publication Data

US 2005/0062292 A1 Mar. 24, 2005

(30) Foreign Application Priority Data

Sep. 24, 2003 (JP) ..... 2003-331994

(51) Int. Cl.
*E05F 11/54* (2006.01)

(52) U.S. Cl. ..... 49/278; 49/276; 49/324

(58) Field of Classification Search ..... 49/276, 49/278, 356, 275, 364, 324, 277
See application file for complete search history.

(56) References Cited

U.S. PATENT DOCUMENTS

| | | | | | |
|---|---|---|---|---|---|
| 443,804 | A | * | 12/1890 | Stamm | 292/34 |
| 671,637 | A | * | 4/1901 | Schuyler | 49/263 |
| 833,331 | A | * | 10/1906 | Michaelis | 254/114 |
| 2,010,680 | A | * | 8/1935 | Van Leuven | 254/131 |
| 2,374,618 | A | * | 4/1945 | Perreton | 49/153 |
| 2,560,419 | A | * | 7/1951 | Ditchfield | 49/208 |
| 3,606,700 | A | * | 9/1971 | Davis | 49/394 |
| 5,469,661 | A | * | 11/1995 | Finkelstein et al. | 49/276 |

FOREIGN PATENT DOCUMENTS

| | | |
|---|---|---|
| JP | 9-137643 | 5/1997 |
| JP | 10-184185 | 7/1998 |
| JP | 2001-271520 | 10/2001 |
| JP | 2002-089107 | 3/2002 |
| JP | 2003-013634 | 1/2003 |
| JP | 2003-155867 | * 5/2003 |
| JP | 2003-193711 | 7/2003 |

* cited by examiner

*Primary Examiner*—Gregory J. Strimbu
(74) *Attorney, Agent, or Firm*—Alston & Bird LLP

(57) ABSTRACT

A door pull (10) has a fixing portion (11) fixed on a door stopper stile (8A) of a door, an operating portion (12) fixed slidably in the opening direction of the door and adapted to slide relative to the fixing portion (11) in the opening direction of the door, and a turning portion (13) supported by the fixing portion (11). A first end of the turning portion (13) is linked turnably with the operating portion (12),and turning in conjunction with sliding of the operating portion (12). A second end of the turning portion (13) projects towards a jamb. When the operating portion (12) slides, an abutment (132) at the second end of the turning portion (13) abuts against the jamb and biases the door in the direction away from the jamb, and the opening operation of the door is assisted.

2 Claims, 10 Drawing Sheets

DOOR PULL AND SASH WINDOW HAVING THE DOOR PULL

BACKGROUND OF THE INVENTION

1. Field of the Invention

The present invention relates to a door pull having an opening assistance mechanism and a sash window.

2. Description of Related Art

An opening assistance mechanism has been proposed in which a trigger protruding from the door stopper stile of a shoji (paper sliding door) towards a jamb, linked with the operation of a door pull for opening the shoji, pushes the jamb to help the opening operation of the shoji (see, for example, Reference Material 1, Japanese Patent Laid Open publication No. Hei 10-184185, pages 3-4, FIGS. 7-10).

According to the opening assistance mechanism disclosed in Reference Material 1, a cylindrical body fixed on the door pull is introduced in an oblong hole of an oscillating body supported by means of a shaft provided in the housing within the door stopper stile, and an operation of the door pull will cause the oscillating body to move in any circular directions. In conjunction with the circular motion, a first magnet is linked slidably in the vertical direction with the oscillating body. Also, a second magnet is mounted on the trigger facing the first magnet, and the attraction or the repulsion of these magnets causes the trigger to project and retroject. Therefore, sliding the door pull in the opening direction of the shoji results in the vertical sliding of the first magnet linked with the oscillating body, and the repulsion of the trigger magnet to the first magnet causes the trigger to project from the door stopper stile to kick the jamb, which helps the opening operation of the shoji.

According to another embodiment of the opening assistance mechanism disclosed in Reference Material 1, a cylindrical body fixed on the door pull is linked with a first rack provided in the housing within the door stopper stile, and this first rack is engaged with a pinion supported by a shaft within the housing. The pinion is engaged with a second rack, and a trigger fixed on this second rack is designed to project and retroject from the door stopper stile as the pinion rotates. Therefore, in this embodiment also, sliding the door pull in the opening direction of the shoji causes the trigger to project from the door stopper stile to kick the jamb through the first rack, pinion and second rack, which helps the opening operation of the shoji.

However, the opening assistance mechanism disclosed in the Reference Material 1 above involves a problem in that its construction is complicated and requires a large number of component parts.

SUMMARY OF THE INVENTION

An object of the present invention is to provide a door pull having an opening assistance mechanism and a sash window simple in construction and including a small number of component parts.

According to an aspect of the present invention, the door pull having an opening assistance mechanism includes a fixing portion provided on the door stopper stile of a shoji in a double sliding window or a single sliding window, an operating portion fixed slidably in the opening direction of the shoji on this fixing portion, and a turning portion supported by the fixing portion with a first end linked turnably with the operating portion and turning as the operating portion slides, and by sliding the operating portion in the direction in which the door stopper stile separates itself from the jamb of the double sliding window or the single sliding window with which the door stopper stile was in contact while the shoji remains closed, a second end of the turning portion that is turned projects towards the jamb, abuts against the jamb and biases the shoji in a direction of separating itself from the jamb.

Here, the fixing portion may be integrated with the door stopper stile, or may be formed separately from the door stopper stile. In other words, it may be constituted by a component fixed on the door stopper stile with a screw or the like.

According to such a structure, the door pull having an opening assistance mechanism can be constituted by a simple construction of the operating portion to be operated for slide, the fixing portion fixed on the door stopper stile, and the turning portion linked turnably with these, and the number of component parts can be reduced.

Moreover, the integration of the fixing portion with the door stopper stile, or the arrangement of supporting the turning portion on the lateral side of the door stopper stile by a shaft and of making the operating portion slidable will further simplify the construction.

On the other hand, if the fixing portion is formed with a member separate from the door stopper stile, it is possible to make a door pull having an opening assistance mechanism into a unit, to fix this door pull unit on a shoji, and to uniform the door pull irrespective of the type and size of the shoji. In addition, the transformation of door pull into a unit will enable to fix the unit door pull on the existing sash window, and to add the opening aid function of shoji to sash windows without replacing the existing shojis.

With this arrangement, it is preferable that the door pull having an opening assistance mechanism of the present invention would be provided with a pair of turning portions and that each of the second ends of the pair of turning portions would abut against the jamb at two vertically separate points.

According to such a structure in which the second ends of a pair of turning portions abut against the jamb at two vertically separate points, it is possible to bias the shojis in a more stable manner.

Specifically speaking, in the case of abutting against and kick the jamb at one point like the conventional opening assistance mechanism, the shoji is subjected to rotation moment depending on the height of this abutting point and sometimes it becomes difficult to bias the shoji smoothly, and it is necessary to determine precisely the position of the abutting point. For this purpose, it is necessary to calculate the position for fixing the door pull by taking into account the optimum abutting point for each type and size of shoji, and when the height/position of a door pull thus fixed is different for each shoji, not only the sense of unity of external design is damaged but also the opening and closing operation of the shoji may be impeded, which creates an inconvenience.

On the other hand, in the case of abutting against the jamb at two vertically separate points for kicking as indicated in the present invention, it becomes possible to set the height/position for fixing the door pull at one's discretion within a range between the upper and lower abutting points provided at positions straddling the optimum abutting point. Therefore, the position for fixing the door pull can be chosen more freely, and it will be possible to improve external appearance and operability by unifying the height/position of the door pull even when the shojis are different in their type and size.

Regarding the door pull having an opening assistance mechanism of the present invention, it is preferable that the operating portion would be fixed on the fixing portion through a parallel maintaining member for preventing the operating portion from inclining during slide.

Here, the parallel maintaining member may be constituted with a guide rail provided on either one of the fixing portion or the operating portion, or a combination of another engaging groove engaging with the guide rail, or may take the form of a member constituted with the fixing portion and the operating portion mutually meshing concavo-convex and slidable only in the sliding direction.

According to such a structure, the parallel maintaining member enables to prevent the operating portion from inclining during slide, and the force that made the operating portion slide in the opening direction of the shoji does not escape and is effectively transmitted from the turning portion to the jamb as the force for assisting the opening of the shoji contributing to the improvement of operability of the opening operation.

In the door pull having an opening assistance mechanism of the present invention, it is preferable that both ends of the parallel maintaining member would be turnably linked to each of the fixing portion and the operating portion, and that the turning portion has a link, the central position thereof being turnably linked with the turning portion.

According to such a structure, by linking the fixing portion, the operating portion and the turning portion in the link and thus constituting a parallel link mechanism, it will be possible to prevent the operating portion from inclining during slide and to improve the external appearance and design of the door pull by incorporating the link in the fixing portion and the operating portion.

According to another aspect of the present invention, the sash window of the present invention, on the other hand, is a sash window including a window frame having a head, a sill, and right and left jambs, double window-type or single window-type shojis supported slidably for opening and closing inside this window frame, and a door pull having the opening assistance mechanism according to the present invention, wherein sliding the operating portion of the door pull in the direction of separating itself from the jamb with which the door stopper stile is in contact while the shojis are closed causes the turning portion of the door pull to turn, and a second end of the turning portion projects towards the jamb and abuts against the jamb, and the shojis are biased in the direction of separating themselves from the jamb.

By adopting such a structure, it is possible to make a sash window having an effect similar to the above described door pull having the opening assistance mechanism. In other words, it is possible to make a sash window having a door pull with an opening assistance mechanism simple in construction and with a reduced number of component parts, in which the opening operation of the shojis is assisted by this door pull and the shojis can be opened with a small operating force.

DETAILED DESCRIPTION OF PREFERRED EMBODIMENTS

Various embodiments of the present invention will be described below with reference to drawings.

It should be noted that in the second embodiment and thereafter the same component parts as those described in the following first embodiment and the component parts having similar functions will be allocated the same codes as the component parts of the first embodiment, and the explanations thereon will be omitted or simplified. It should also be noted that, in each figure, the hatching that shows the cross section of the main component part is omitted.

First Embodiment

A double sliding window 1 as a sash window and a door pull 10 having an opening assistance mechanism according to the first embodiment of the present invention will be described with reference to FIGS. 1-6.

Figure 1:
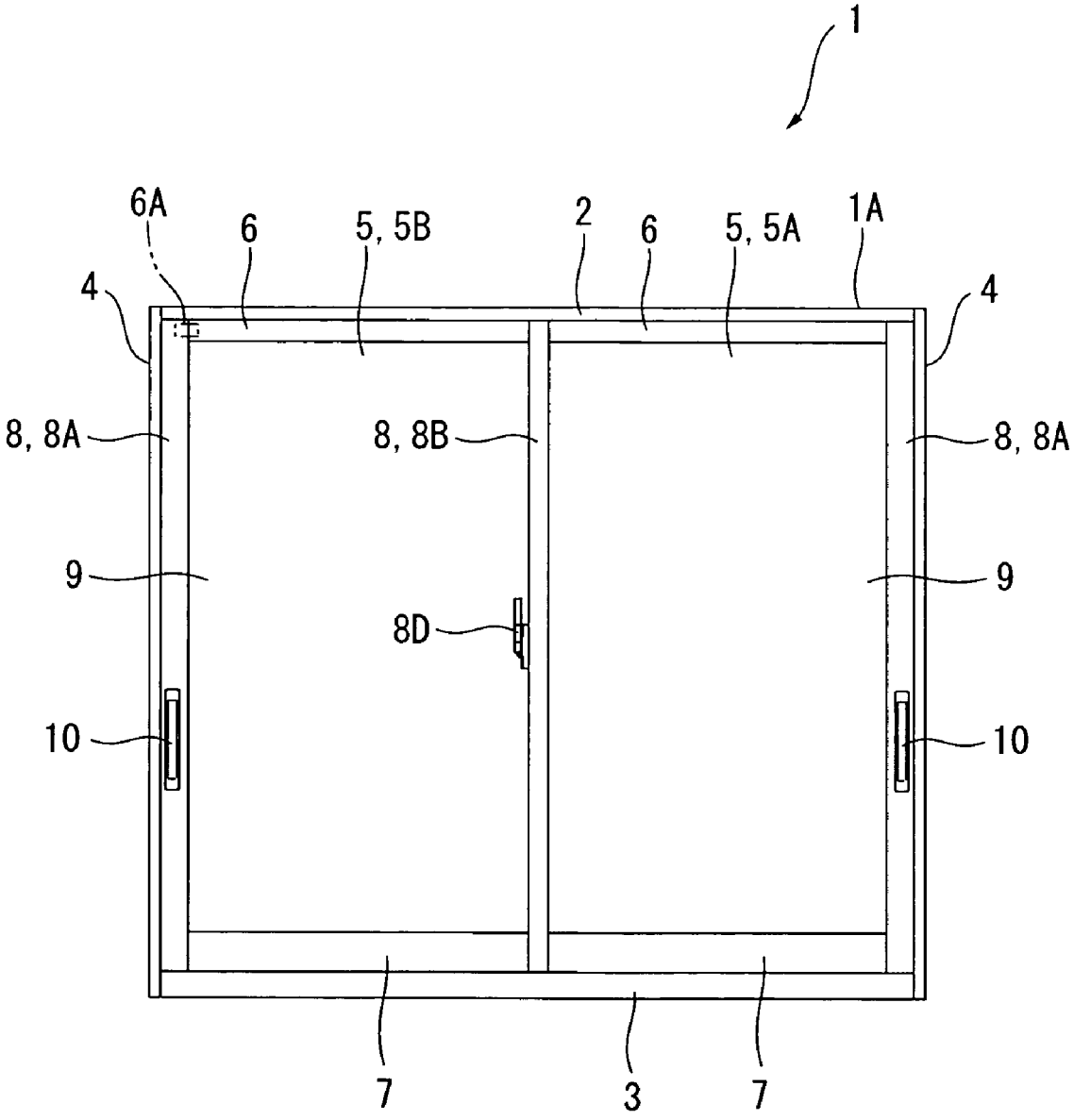
FIG. 1 is a front view showing a double sliding window as seen from the inside of a room according to a first embodiment of the present invention.
Figure 2:
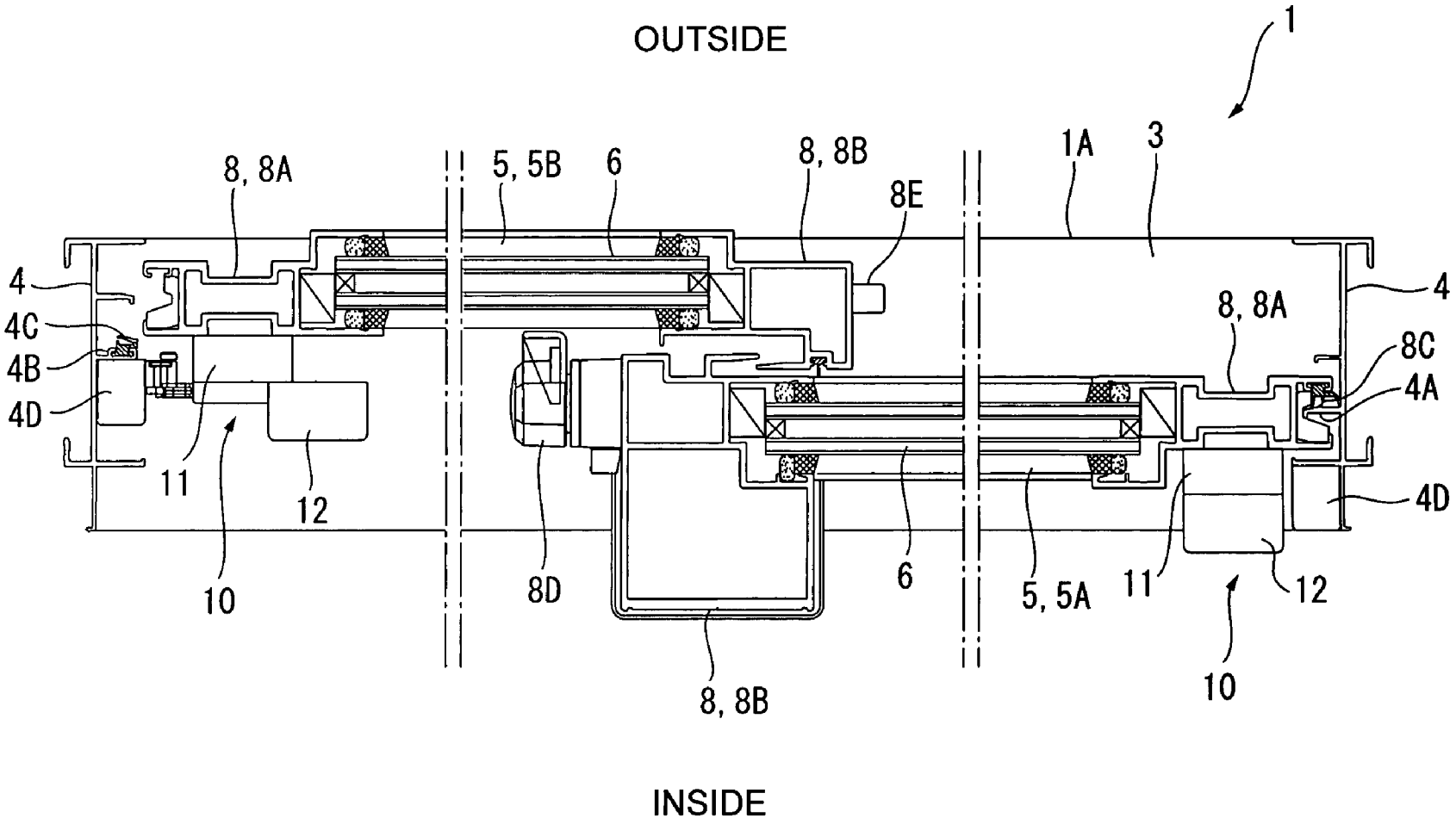
FIG. 2 is a transverse cross sectional view showing the double sliding window.

FIGS. 1 and 2 are respectively a front view as seen from the inside of a room and a transverse cross sectional view showing the double sliding window 1 of the present embodiment.

It should be noted that the sash window of the present invention is not limited to the double sliding window 1, but may be a single sliding window.

In FIGS. 1 and 2, the double sliding window 1 includes a window frame 1A constituted with a head 2, a sill 3, and right and left jambs 4 respectively made of aluminum extruded material and integrated by the quadrate framing process, and a pair of shojis 5 supported slidably for opening or closing within this window frame 1A. The shoji 5 includes a sash made with extrusion molded aluminum material constituted with a top rail 6, a bottom rail 7 and right and left stiles 8 integrated by the quadrate sash forming process and a window pane 9 framed therein. A pair of shojis 5 includes an inward shoji 5A and an outward shoji 5B, and the jamb 8 for each of the inward and outward shojis 5A and 5B is constituted with a door stopper stile 8A abutting against the jamb 4 and a meeting stile 8B that overlaps with the other meeting stile at approximately the center of the lateral length of the window frame 1A while the shoji 5 is closed.

On the door stopper stile 8A of the inward shoji 8A, an airtight piece 8C is provided to abut against the outward side of a protruding piece 4A formed on the lateral side of the jamb 4, and while the inward shoji 5A is closed, the airtight piece 8C closely abuts against the protruding piece 4A of the jamb 4 to maintain airtightness.

On the lateral side of the jamb 4 against which the door stopper stile 8A of the inward shoji 5B abuts, a protruding piece 4B is formed, and on the outward side of this protruding piece 4B an airtight piece 4C is provided. And while the outward shoji 5B is closed, the airtight piece 4C of the jamb 4 abuts against inward side of the door stopper stile 8A to maintain airtightness.

A crescent 8D is provided on the meeting stile 8B of the outward shoji 5B with the inward shoji 5A. When a turning hook provided on the meeting stile 8B on the inward side is turned to engage with a hook receiver provided on the meeting stile 8B on the outward side, the double sliding window 1 is locked.

Figure 3:
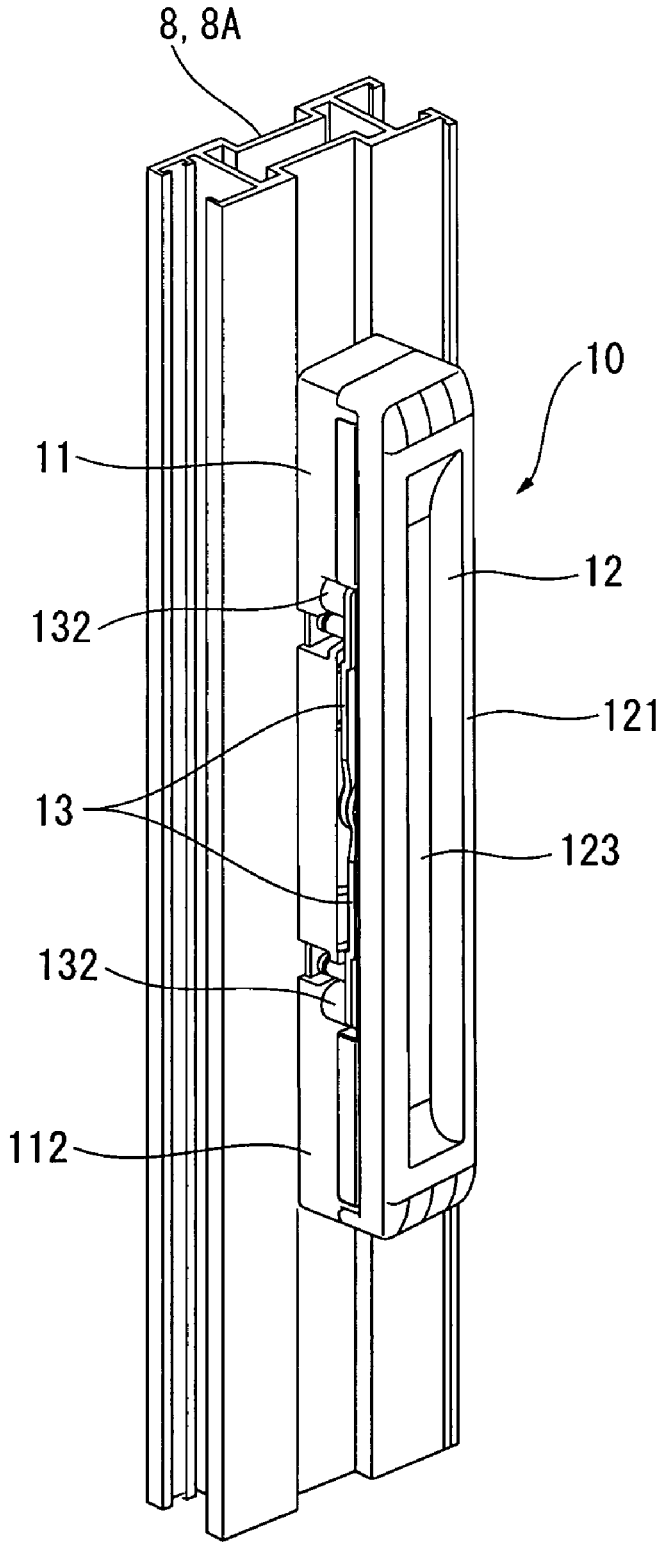
FIG. 3 is a perspective view showing a door pull provided on the double sliding window.
Figure 4:
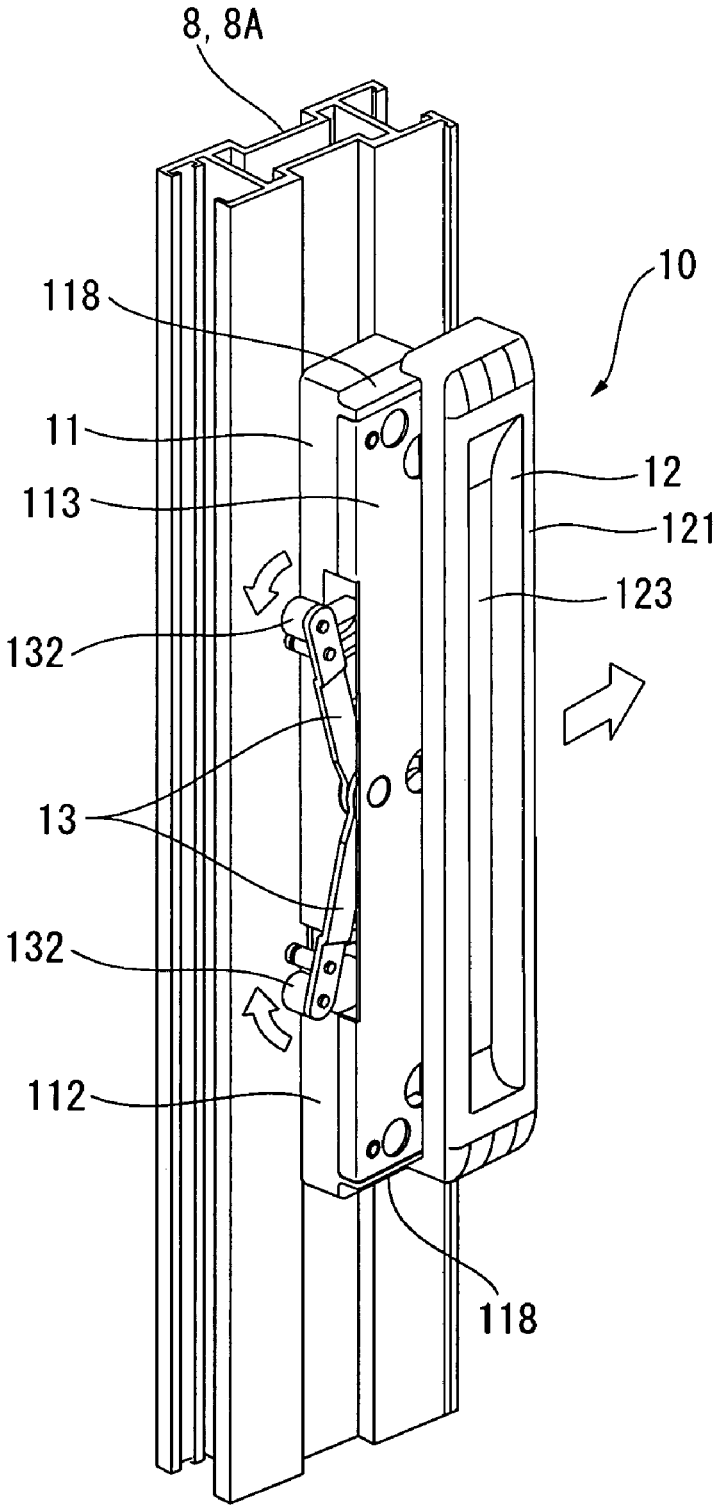
FIG. 4 is a perspective view showing a state of the door pull after sliding operation.
Figure 5:
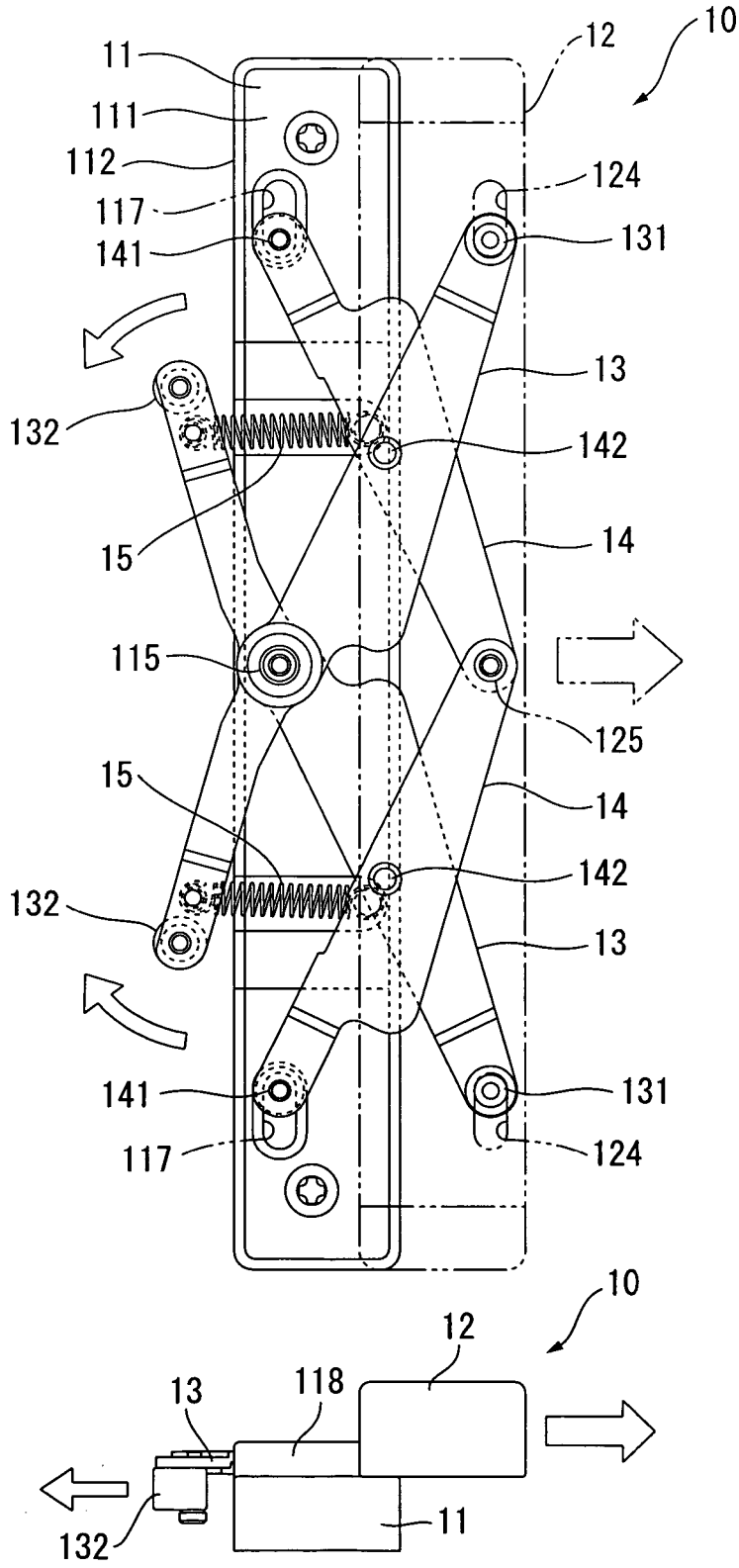
FIG. 5 is a front view and bottom plan view of the door pull from which a part is omitted.
Figure 6:
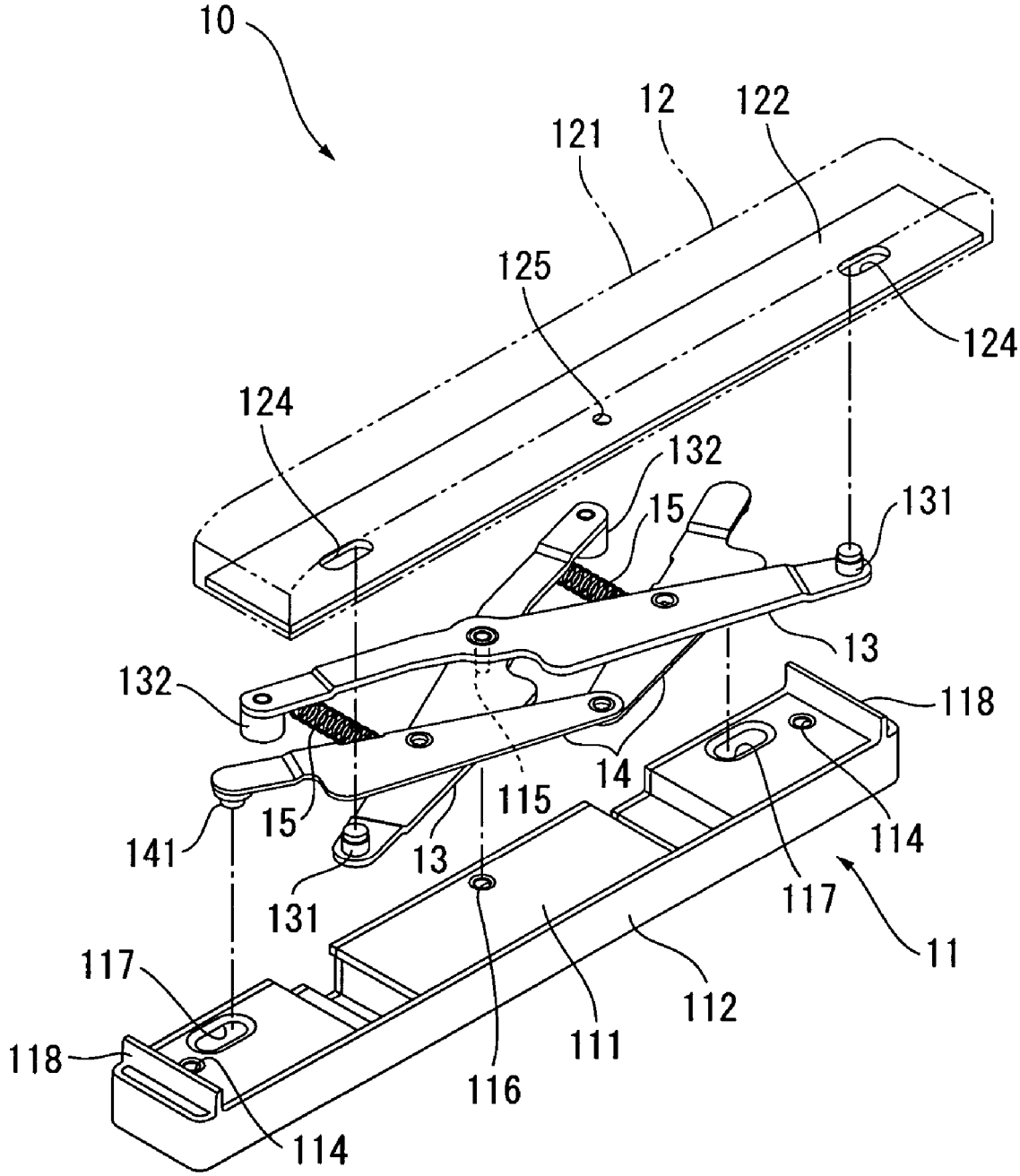
FIG. 6 is an exploded perspective view of the door pull from which a part is omitted.

Next, the door pull 10 provided on the door stopper stile 8A of the inward and outward shojis 5A and 5B will be described with reference to FIGS. 3-6. FIGS. 3 and 4 are perspective views showing respectively the door pull 10, and FIG. 4 is a perspective view showing a state of the door pull 10 after sliding operation. FIG. 5 is a front view and a bottom plan view showing the door pull 10 of which a part is omitted. FIG. 6 is an exploded perspective view of the door pull 10 from which a part is omitted.

The door pull 10 is a vertically long member wholly in the form of approximately square pillar fixed on the inward side of the door stopper stile 8A so that the inward and outward shojis 5A and 5B may be opened and closed by the force of a finger applied thereon. And the door pull 10 is fixed, as shown in FIG. 1, at a height/position lower than the crescent 8D fixed on the meeting stile 8B and not interfering the crescent 8D when the inward and outward shojis 5A and 5B are fully opened. However, the door pull 10 may be fixed at a height/position higher than the crescent 8D and not interfering the crescent 8D.

And as shown in FIG. 2, a resin-made receiver 4D is provided on the lateral surface of the jamb 4 opposite to the inward and outward door pulls 10, so that an abutment 132 of the door pull 10 to be described later abuts against the receiver 4D.

The opened inward shoji 5A is restricted of its opening operation by the abutment of the meeting stile 8B against a crescent stopper (not shown) provided at an end of the sill 3 on a side of the jamb 4 so that the door pull 10 may not collide with the meeting stile 8B of the inward shoji 5A. And when the outward shoji 5B is opened, a stopper 8E fixed on the meeting stile 8B of the outward shoji 5B (shown in FIG. 2) abuts against the jamb 4, or the meeting stile 8B of the outward shoji 5B abuts against a shoji stopper (not shown) provided at the end of the sill 3, so that the door pull 10 may not collide with the meeting stile 8B of the inward shoji 5A. In addition, even when the inward and outward shojis 5A and 5B are opened at the same time, a stopper 6A shown in FIG. 1 provided on the inward side of the head 6 of the inward shoji 5A enables to prevent the door pull 10 from colliding with the meeting stile 8B of the outward shoji 5B due to the abutment of this stopper 6A against the outward shoji 5B before the door pull.

It is also possible to prevent the door pull 10 from interfering the crescent 8D by adjusting the position of the stopper 6A even when the door pull 10 and the crescent 8D are set at approximately the same height/position.

The door pull 10 includes, as shown in FIGS. 3-6, a fixing portion 11 fixed by a screw on the door stopper stile 8A, an operating portion 12 provided on the inward side of this fixing portion 11, a pair of turning portions 13 supported by the fixing portion 11 by a turn shaft and a first end of which is linked with the operating portion 12, a pair of links, the both ends of which being turnably linked with each of the fixing portion 11 and the operating portion 12 and the middle part of which being turnably linked with the turning portion 13. And the door pull 10 is produced as a separate unit from the door stopper stile 8A, and after the shoji 5 is formed by assembling various rails and stiles 6, 7 and 8 as well as the window pane 9, the door pull 10 can be mounted on the door stopper stile 8A.

In the meanwhile, it is also possible to fix a door pull 10 on a door stopper stile 8A before a shoji 5 is assembled, and then the shoji 5 may be assembled.

The fixing portion 11 of the door pull 10 includes a metal base 111 (FIGS. 5 and 6), a resin-made package 112 covering the periphery of this base 111 and a metal cover 113 covering the inward side of the fixing portion 11 (FIG. 4). Here, the fixing portion 11 is fixed on the inward side of the door stopper stile 8A by a screw through screw holes 114 provided on the base 111.

On the jamb 4 side at approximately the center of the longitudinal direction of the base 111, an insert hole 116 is created for inserting a pin 115 (FIGS. 5 and 6) which supports the turning portions 13 as a shaft. On the jamb 4 side at both ends in the longitudinal direction of the base 111, oblong holes 117 are created for inserting pins 141 provided respectively on an end of each of a pair of links 14 and for guiding the pins 141 in the longitudinal direction of the base 111. At both ends in the longitudinal direction of the package 112 of the fixing portion 11, guide components 118 are formed for guiding the operating portion 12 in the opening direction (the right and left directions in FIGS. 1 and 2) of the shoji 5.

The operating portion 12 of the door pull 10 includes a resin-made package 121 having a shape covering approximately the whole inward side of the fixing portion 11, and a metal plate 122 (FIG. 6) provided to face the fixing portion 11 in this package 121. The package 121 includes a concave groove 123 for hooking a finger at the time of operation extending in the longitudinal direction. The operating portion 12 is slidable in the opening direction of the shoji 5 relative to the fixing portion 11 as the both ends in the longitudinal direction of the package 121 are engaged with the guide component 118 formed in the package 112 of the fixing portion 11 to be guided thereby. In other words, the guide component 118 of the fixing portion 11 and the package 121 of the operating portion 12 engaged with the guide component 118 constitute the parallel maintenance of the operating portion 12.

At the both ends in the longitudinal direction of the plate 122, on the other hand, oblong holes 124 (FIGS. 5 and 6) are created for inserting pins 131 respectively provided at first ends of a pair of turning portions and for guiding this pin 131 in the longitudinal direction of the operation component 12. In addition, at approximately the center in the longitudinal direction of the plate 122, insert holes 125 are created for supporting respectively second ends of a pair of links 14.

A pair of turning portions 13 of the door pull 10 are formed in the shape of a long rectangular bar respectively from a metal plate, and are disposed mutually crossing at the position of the pin 115 supporting on the fixing portion 11. In other words, a pair of turning portions 13 is arranged turnably around the pin 115 as a rotation axis along the depth direction of the shoji 5. At a first end of the turning portion 13, a pin 131 to be inserted into an oblong hole 124 formed on the plate 122 of the operating portion 12 projects to the side of the operating portion 12. Here, each of a second ends of a pair of turning portions 13 is formed extending to the opposite side of the first end side across the position of the pin 115, and resin-made abutments 132 are fixed on these second ends. These abutments 132 are fixed to project above the surface on the side of the fixing portion 11 of the turning portion 13, and are fixed turnably around the axis of rotation along this protrusion direction. The distance between the abutment 132 and the pin 115 as the supporting position of the turning portion 13 is shorter than the distance between the pin 115 and the pin 131 at the first end of the turning portion 13.

And coil springs 5 are linked between the second ends of the turning portions 13 contiguous to the abutment 132 and the fixing portion 11 as a bias, and the second ends of the turning portions 13 are biased by the coil springs 15 in the direction of separating themselves from the jamb 4 (to the right in FIG. 5), in other words, in the direction to be stored in a space between the fixing portion 11 and the operating portion 12 (to return to the state shown in FIG. 3).

A pair of links 14 of the door pull 10 are respectively formed by metal plates, and are supported by the turning portion 13 through the pin 142 by way of shaft in the approximately position between the pin 115 as the supporting position of the turning portions 13 and the first end of the turning portions 13. Here, the pin 141 is fixed at a first end of the link 14 and this pin 141 is inserted into the oblong hole 117 of the fixing portion 11, and the second end of the link 14 is supported by the insert hole 125 of the operating portion 12. In this way, the both ends of the links 14 are turnably linked with the fixing portion 11 and the operating portion 12. A pantograph-shaped parallel link mechanism is formed by the turning portions 13 and the links 14 linked as described above, and this parallel link mechanism enables the operating portions 12 to slide by maintaining parallelism with the fixing portion 11. In other words, the turning portions 13 and the links 14 mutually linked constitute the parallel maintenance member of the operation components 12.

With the door pull 10 as described above, when the operating portion 12 is pulled by applying a finger on the concave groove 123 of the operating portion 12 in the opening direction of the shoji 5 (to the right shown by the arrow in FIGS. 4 and 5) while the shojis are closed, the operating portion 12 slides relative to the fixing portion 11 and the second ends of the turning portions 13 project towards the jambs 4 (to the left in FIGS. 4 and 5). Then, a pair of abutments 132 abut against the jamb 4 (receiver 4D) at two vertically separate points, and this abutting force biases the shoji 5 in the opening direction causing the shoji 5 to separate itself from the jamb 4. Thus, the opening operation of the shoji 5 is assisted.

To be more specific, when the operating portion 12 is led to slide, the first end of each of the turning portions 13 moves together with the operating portion 12 in the opening direction of the shoji 5, and moves towards the center in the longitudinal direction along the oblong hole 124, so that the second ends of the turning portions 13 that turned around the pin 115 project towards the jamb 4. At the same time, the second ends of the links 14 move together with the operating portion 12 in the opening direction of the shoji 5, and the first end that turned around the pin 142 moves towards the center in the longitudinal direction along the oblong hole 117 preventing the operating portion 12 from inclining relative the fixing portion 11.

And due to a shorter distance between the abutment 132 and the pin 115 than the one between the pin 115 and the first end of the turning portion 13 in the lever system taking the pin 115 as the supporting point, a first end of the turning portion 13 as the power point and the abutment 132 as the point of action, a greater kicking force can be obtained with which the abutment 132 kicks the jamb 4 in comparison with the force needed to operate the operating portion 12.

When the sliding operation of the operating portion 12 is suspended, due to the biasing force of the coil spring 15 linked with the second end of the turning portions 13, the turning portion 13 is stored in a space spanning between the fixing portion 11 and the operating portion 12, and the operating portion 12 returns to the initial position covering the inward side of the fixing portion 11. Therefore, when the door pull 10 is pulled towards the jamb 4 to close the shoji 5, the abutment 132 of the turning portion 13 has not projected, and the shoji 5 can be closed without causing the abutment 132 to collide with the jamb 4.

According to the present embodiment describe above, the following advantages can be obtained.

(1) Due to a simple construction of the door pull 10 having an opening assistance mechanism including the fixing portion 11 fixed to the door stopper stile 8A, the operating portion 12 operated for slide, and the turning portion 13 turnably linked with the foregoing, complicated component parts such as magnet, rack, pinion required in the conventional door pulls are no longer required, and therefore it is possible to reduce the number of component parts.

(2) The simplified construction of the door pull 10 enables to miniaturize the door pull 10 and to reduce the dimension of inward protrusion of the door pull 10. Also, due to the adoption of a structure wherein the abutment 132 of the turning portion 13 kicks the jamb 4 in conjunction with the slide operation of the operating portion 12, it is possible to set the operation range of the operating portion 12 to be smaller compared with the system interlinked with the circular operation of a handle or the like, so that the balance of incomplete pull of the shoji 5 can be reduced.

(3) Due to a special arrangement to make the door pull 10 a unit separate from the door stopper stile 8A, it is possible to uniform the door pull 10 irrespective of the type or dimension of the shoji 5. In addition, due to the arrangement to make the door pull 10 a unit, it has become possible to mount the same on the existing sash window, and it will be possible to add the opening assistance function of the shoji to sash windows without replacing the existing shojis.

(4) Since the abutments 132 provided on each second end of a pair of turning portions 13 abut against the jamb 4 at two vertically separated points, it is possible to stabilize the biasing force liberated to the shojis 5. In addition, it is possible to uniform the height/position of the door pull 10 and to improve external appearance and design even if the types and dimensions of the shoji 5 are different by setting adequately the position of fixing the door pull 10 on the door stopper stile 8A within a range between the upper and lower abutting points.

(5) Since the distance between the abutment 132 and the pin 115 is made shorter than the distance between the pin 115 and the first end of the turning portion 13, due to the its leverage, it is possible to have the abutment 132 kick the jamb 4 with a great kicking force even if the force of operating the operating portion 12 may be small.

(6) Due to the construction of the parallel maintenance member of the operating portion 12 with the guide component 118 of the fixing portion 11, and the package 121 of the operating portion 12 engaged with the guide component 118, the operating portion 12 is guided in the opening direction of the shojis 5 without inclining, and the operability of the opening operation of the shojis 5 can be improved.

(7) Due to the construction of the parallel maintenance member of the operation component 12 by linking the link 14 with the fixing portion 11, the operating portion 12 and the turning portion 13, the force that made the operating portion 12 to slide does not escape and is transmitted to the jamb 4 through the turning portion 13 as an assisting force for opening the shojis 5, and the shojis 5 can be more smoothly opened and closed.

(8) The parallel maintenance member constituted with the mutually linked turning portion 13 and the link 14, covered by the operating portion 12 and invisible from the inward side while the turning portion 13 and the link 14 are not operated, can improve the external appearance and design of the door pull 10.

[Second Embodiment]

Next, a door pull 20 having an opening assistance mechanism according to the second embodiment of the present invention will be described with reference to FIGS. 7-10.

Figure 7:
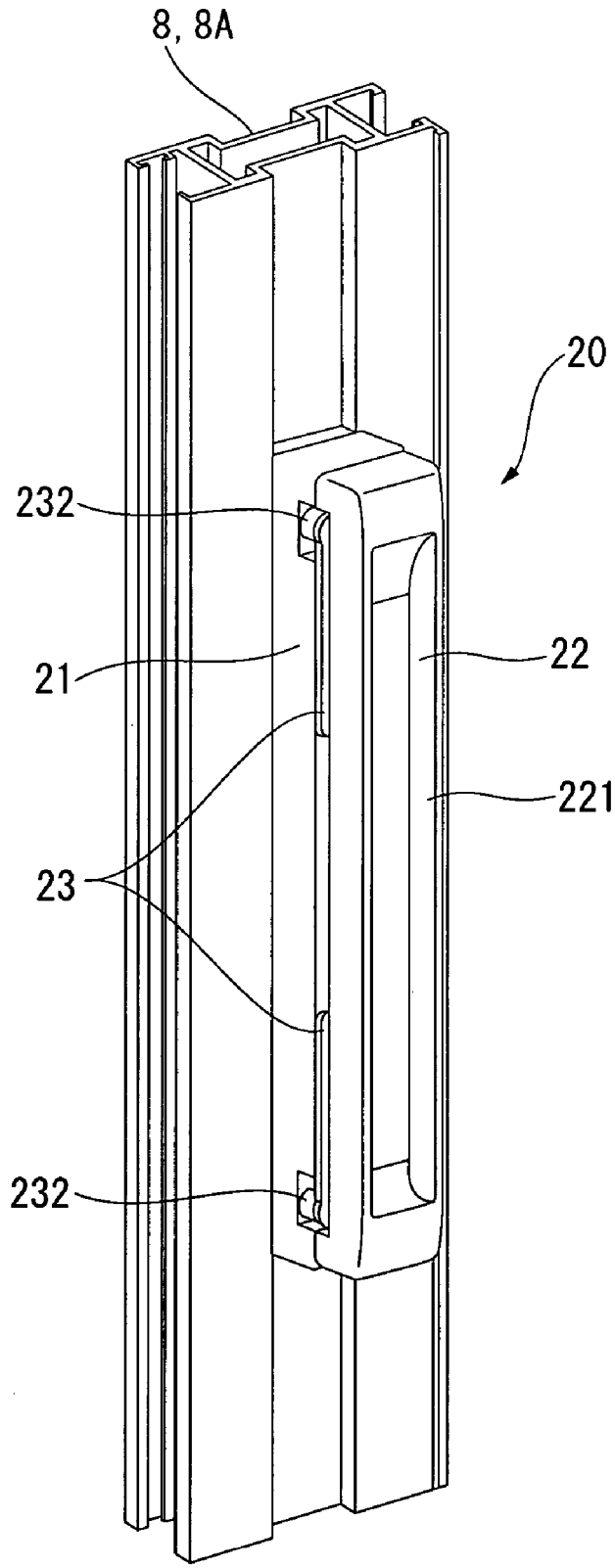
FIG. 7 is a perspective view showing a door pull according to a second embodiment of the present invention.
Figure 8:
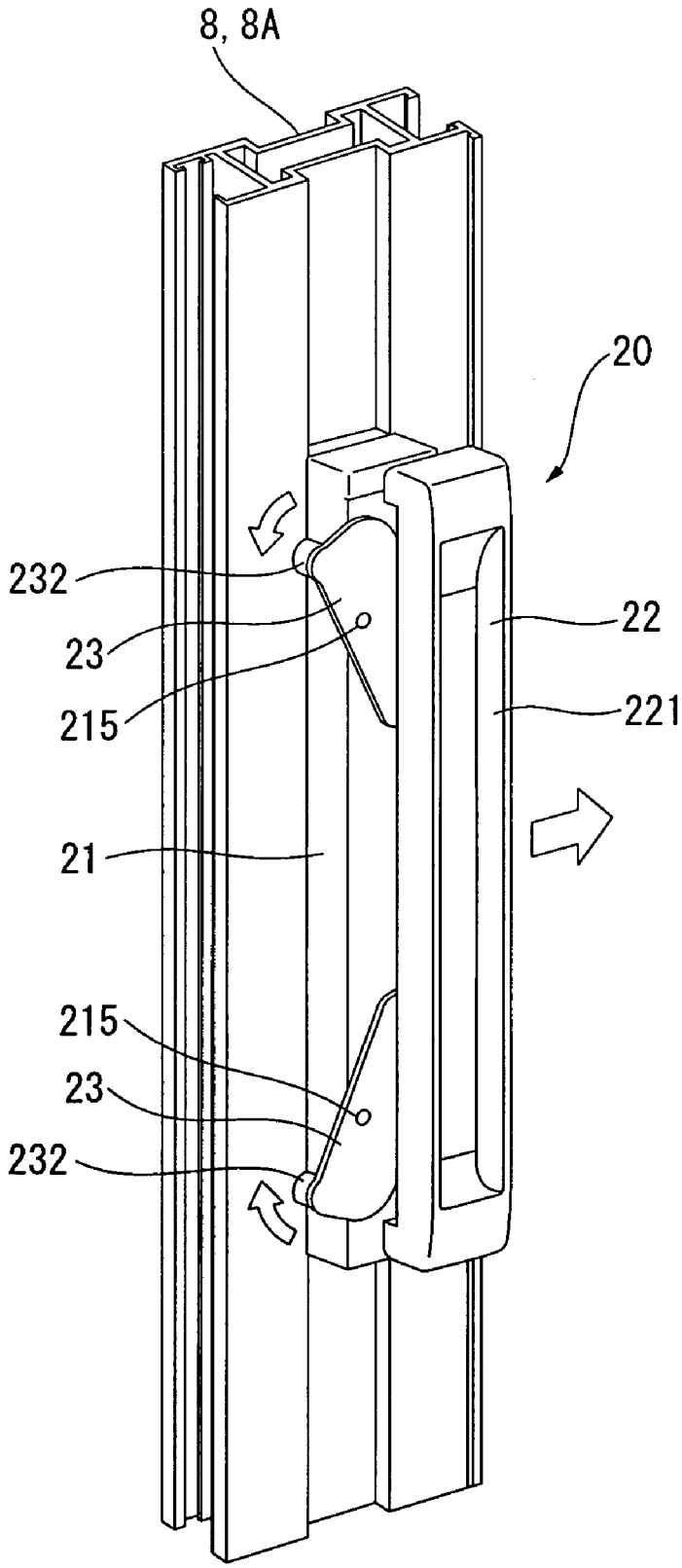
FIG. 8 is a perspective view showing a state of the door pull after sliding operation.
Figure 9:
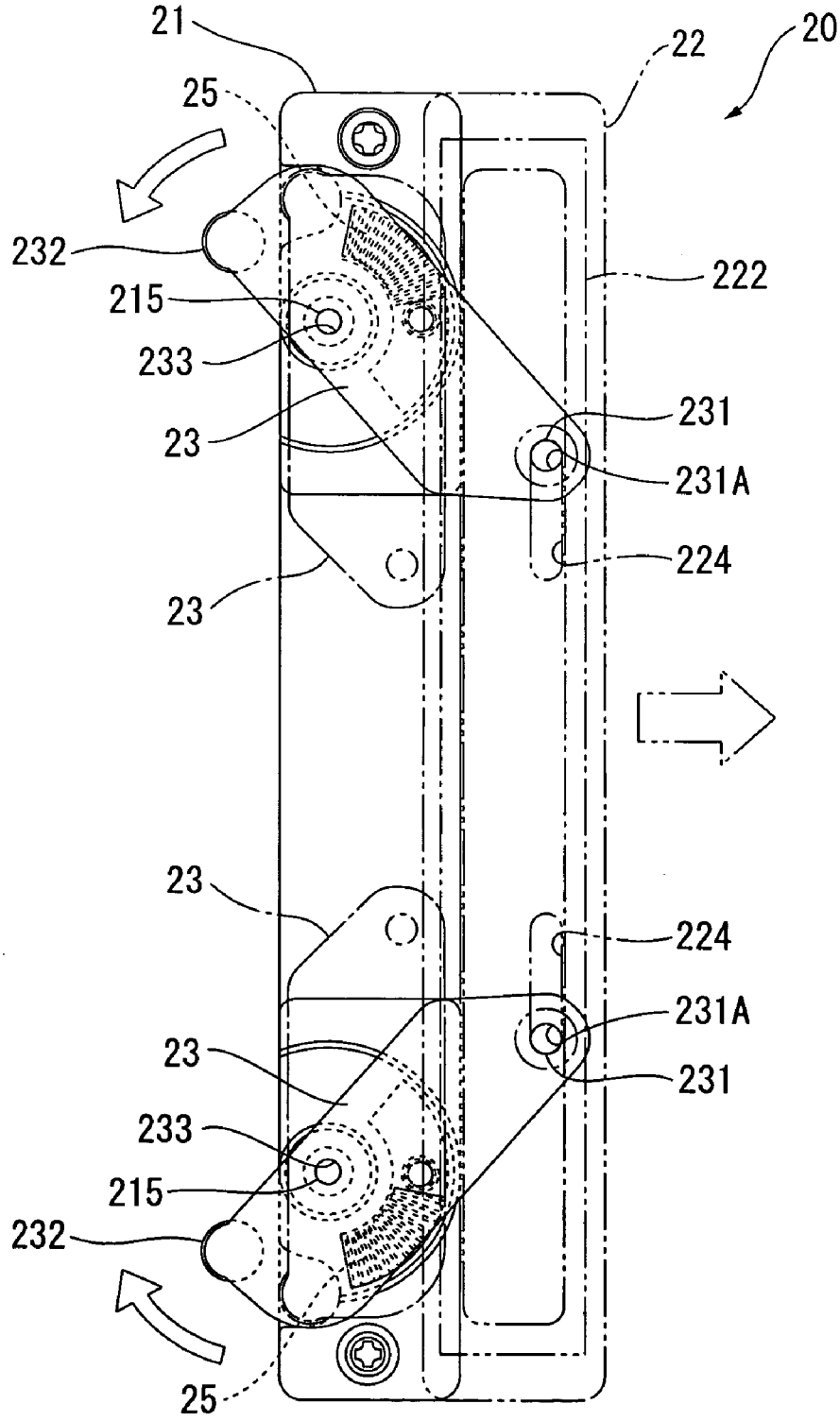
FIG. 9 is a front view of the door pull from which a part is omitted.
Figure 10:
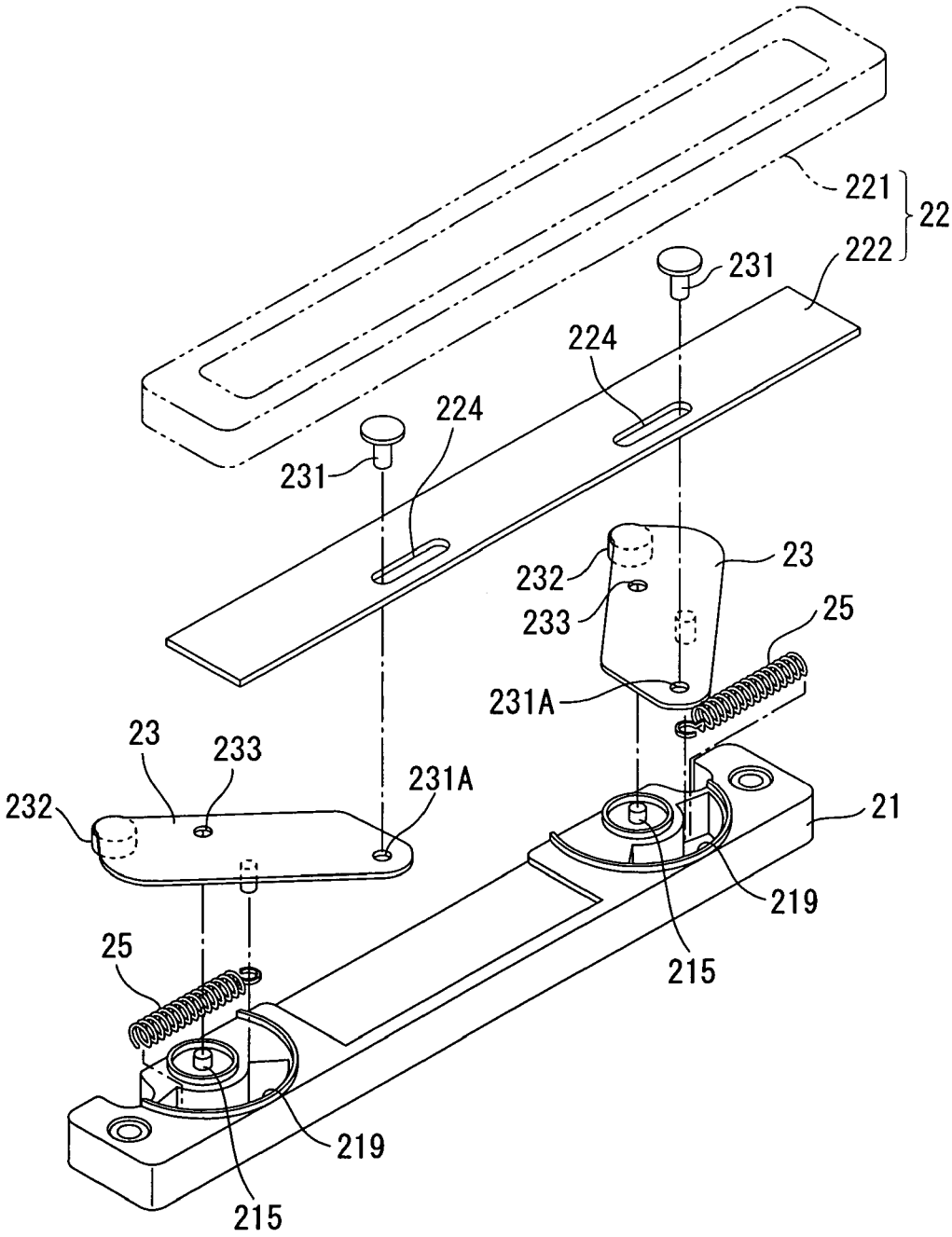
FIG. 10 is an exploded perspective view of the door pull from which a part is omitted.

FIGS. 7 and 8 are respectively perspective views showing the door pull 20, and FIG. 8 showing the state of the door pull 20 after sliding operation. FIG. 9 is a front view showing the door pull 20 from which a part is omitted. FIG. 10 is an exploded perspective view showing the door pull 20 from which a part is omitted.

The door pull 20 of the present embodiment is different from the door pull 10 of the first embodiment in respect of the constitution of a turning portion, and is mostly similar with respect to the constitution of other parts of the door pull and the constitution of a sash window on which this door pull 20 will be mounted. The following are detailed descriptions of differences.

In FIGS. 7-10, the door pull 20 is, like the first embodiment described above, a vertically long rectangular component and includes a fixing portion 21 fixed by means of a screw to the inward surface of the door stopper stile 8A, an operating portion 22 slidably fixed to this fixing portion 21, and a pair of turning portions 23 supported by the fixing portion 21 by way of a shaft and with a first end linked with the operating portion 22.

On the side of a jamb 4 at both ends in the longitudinal direction of the fixing portion 21, a pin 215 (FIGS. 9 and 10) supporting turning portion 23 as a shaft are provided. The operating portion 22 includes a package 221 and a metal plate 222, and on the plate 222 an oblong hole 224 (FIGS. 9 and 10) is created to insert a pin 231 linking the first end of a pair of turning portions 23 and guiding this pin 231 in the longitudinal direction of the operating portion 22.

A pair of turning portions 23 of the door pull 20 is respectively formed approximately in the rectangular shape from a metal plate, and the insert holes 233 supported by the pins 215 of the fixing portion 21, and are arranged turnably around the pins 215 serving as shafts along the depth direction of the shoji 5. On the first end of the turning portion 23, insert holes 231A are created, and the first end of the turning portions 23 is linked with the operating portion 22 due to the linkage of the pins 231 inserting through the oblong holes 224 formed on the plate 122 of the operating portion 22 with the insert holes 231A. On second ends of a pair of the turning portions 23 across the insert holes 233 turning portion, resin-made abutments 232 are fixed. The distance between this abutment 232 and the insert hole 233 as the supporting position of the turning portion 23 is shorter than the distance between the insert hole 233 and the insert hole 231A representing the first end of the turning portion 23.

Also, the turning portion 23 and the fixing portion 21 are linked by a coil spring 25 disposed in an approximately semicircle shaped groove 219 formed in the fixing portion 21 as a biasing member, and the turning portion 23 is biased by the coil spring 25 in a direction to be stored a space between the fixing portion 21 and the operating portion 22 (the state shown in FIG. 7 or the state shown by chain lines in FIG. 9).

In a door pull 20 as described above, a pull of the operating portion 22 in the opening direction (to the right as shown by the arrows in FIGS. 8 and 9) of the shoji 5 while the shojis are closed will cause the operating portion 22 to slide relative to the fixing portion 21, and cause the second end of the turning portions 23 to project towards the side of the jamb 4 (to the left in FIGS. 8 and 9). And a pair of abutments 232 abut against the jamb 4 (receiver 4D) at two vertically separate points, and this abutting force biases the shoji 5 in the opening direction causing the shoji 5 to separate itself from the jamb 4. Thus, the opening operation of the shoji 5 is assisted.

With this arrangement, due to a shorter distance between the abutment 232 and the pin 215 than the one between the pin 215 and the first end of the turning portion 23 in the lever system taking the pin 215 as the supporting point, the first end of the turning portion 23 as the point of force and the abutment 232 as the point of action, a greater kicking force can be obtained with which the abutment 232 kicks the jamb 4 in comparison with the force needed to operate the operating portion 22.

When the sliding operation of the operating portion 22 is suspended, due to the biasing force of the coil spring 25 linked with the turning portions 23, the turning portion 23 is stored in a space spanning between the fixing portion 21 and the operating portion 22, and the operating portion 22 returns to the initial position covering in the inward side of the fixing portion 21. Therefore, when the door pull 20 is pulled towards the jamb 4 to close the shoji 5, the abutment 232 of the turning portion 23 has not projected, and the shoji 5 can be closed without causing the abutment 232 to collide with the jamb 4.

According to present embodiment as described above, the following advantages can be obtained as well as advantages similar to (1)-(5).

(9) Due to the disposition of the coil spring 25 in the groove 219 of the fixing portion 21, the coil spring 25 is not exposed during the slide operation of the operating portion 22. This contributes to a better external appearance and prevents any rubbishes or dusts from falling on the coil spring 25.

Incidentally, the scope of the present invention is not restricted to the above embodiments but includes following modifications as long as an object of the present invention can be achieved.

For example, according to the embodiments described above, the door pulls 10 and 20 are produced separately from the door stopper stile 8A, and they are mounted on the door stopper stile 8A after the assembly of the shoji 5 is completed. However, such a process is not exclusive and the door pull and the door stopper stile 8A may be produced integrally. More specifically, the door pull and the door stopper stile 8A may be produced integrally by supporting the turning portions 13 and 23 by the inward surface of the door stopper stile 8A and also by providing slidably the operating portions 12 and 22. In this way, it is possible to further simplify the construction of the door pull.

And in the door pull 10 or 20 of the embodiments described above, a pair of (two) turning portions 13 or 23 are provided. However, such structure is not obligatory, and only one turning portion 13 or 23 may be provided, and more than two turning portions may be provided.

Further, according to the arrangements described in the above embodiments, the operating portion 12 or 22 and the turning portion 13 or 23 of the door pull 10 or 20 are biased in the direction of returning to the initial position by the coil spring 15 or 25 representing a biasing member. However, it is possible to omit the coil spring 15 or 25.

Moreover, in the door pull 10 of the first embodiment described above, a pair of turning portions 13, the fixing portion 11 and the operating portion 12 are linked by a pair of links 14 to form a pantograph-shaped parallel link mechanism and to constitute a parallel maintenance member of the operating portion 12. However, any link mechanism other than one of such structure may be used to construct a parallel maintenance member. Also, the door pull 10 of the first embodiment includes a parallel maintenance member constituted by the guide component 118 of the fixing portion 11 and the package 121 of the operating portion 12 engaged with the guide component 118 in addition to a parallel maintenance member constituted by the link 14. Only one of these parallel maintenance members may be provided or both may be omitted.

While the door pull 20 of the second embodiment described above includes no parallel maintenance member for preventing the operating portion 22 from inclining, a parallel maintenance member similar to the first embodiment may be provided.

In addition, although the best configuration, method, and the like for implementing the present invention have been disclosed above, the present invention is not limited to the best configuration. In other words, the present invention is mainly illustrated and described on the specific embodiment, however, a person skilled in the art can modify the specific configuration such as shape, material, quantity on the above-described embodiment as long as a technical idea and an object of the present invention can be achieved.

Accordingly, since the present invention is not limited to the above disclosed form, material or the like but they are described as examples for easy understanding, includes a description with names of components excluding a part or all of the limitation on the form and material etc.

What is claimed is:

1. A pull comprising:

a fixing portion fixed on a stopper stile of a closure supported slidably within a frame, said frame comprising a head, a sill, and a first jamb, and a second jamb;

an operating portion disposed adjacent said fixing portion, said operating portion being linearly slidable relative to said fixing portion along an operating axis, said operating axis being substantially parallel to an opening direction of said closure; and a turning portion supported by said fixing portion and said turning portion turns while said operating portion slides, a first end of said turning portion being turnably linked with said operating portion, wherein:

said stopper stile is in contact with said first jamb of said frame while said closure is closed;

by sliding said operating portion along said operating axis in a direction away from said first jamb, a second end of said turning portion is turned and projects towards said first jamb and abuts against said first jamb, and said turning portion biases said closure to move the closure away from said first jamb;

said operating portion is linked to said fixing portion through a parallel maintenance member disposed adjacent said fixing portion, said parallel maintenance member maintaining an orientation of said operating portion during sliding of said operating portion along said operating axis;

wherein said parallel maintenance member comprises a link, a middle portion of said link being turnably linked with said turning portion, one end of said link being turnably linked with said fixing portion and another end of said link being turnably linked with said operating portion.

2. A sash window comprising:

a window frame having a head, a sill, a first jamb, and a second jamb;

a closure supported slidably within said window frame; and a pull mounted on a stopper stile of said closure, wherein: the pull comprises:

a fixing portion fixed on said stopper stile of said closure in said window frame;

an operating portion disposed adjacent said fixing portion, said operating portion being linearly slidable relative to said fixing portion along an operating axis, said operating axis being substantially parallel to an opening direction of said closure; and a turning portion supported by said fixing portion and said turning portion turns while said operating portion slides, a first end of said turning portion being turnably linked with said operating portion, wherein:

said stopper stile is in contact with said first jamb while said closure is closed;

by sliding said operating portion of said pull along said operating axis in a direction away from said first jamb, said turning portion is turned such that a second end of said turning portion projects towards said first jamb, abuts against said first jamb, and the turning portion biases said closure to move the closure away from said first jamb;

said operating portion is linked to said fixing portion through a parallel maintenance member disposed adjacent said fixing portion, said parallel maintenance member maintaining an orientation of said operating portion during sliding of said operating portion along said operating axis; and wherein said parallel maintenance member comprises a link, a middle portion of said link being turnably linked with said turning portion, one end of said link being turnably linked with said fixing portion and another end of said link being turnably linked with said operating portion.

* * * * *